US011359524B1

(12) United States Patent
Na et al.

(10) Patent No.: US 11,359,524 B1
(45) Date of Patent: Jun. 14, 2022

(54) COMPRESSION RELEASE TYPE ENGINE BRAKE

(71) Applicants: Hyundai Motor Company, Seoul (KR); Kia Corporation, Seoul (KR)

(72) Inventors: Woong Na, Hwaseong-Si (KR); Jae Hee Jeon, Hwaseong-Si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/357,858

(22) Filed: Jun. 24, 2021

(30) Foreign Application Priority Data

Dec. 30, 2020 (KR) ..... 10-2020-0187323

(51) Int. Cl.

| | |
|---|---|
| ***F01L 13/06*** | (2006.01) |
| ***F01L 1/24*** | (2006.01) |
| ***F01L 1/26*** | (2006.01) |
| ***F01L 1/18*** | (2006.01) |
| ***F02D 13/04*** | (2006.01) |
| *F01L 1/08* | (2006.01) |

(52) U.S. Cl.
CPC ..... *F01L 13/065* (2013.01); *F01L 1/181* (2013.01); *F01L 1/2411* (2013.01); *F01L 1/267* (2013.01); *F02D 13/04* (2013.01); *F01L 1/08* (2013.01); *F01L 2001/2444* (2013.01); *F01L 2305/00* (2020.05)

(58) Field of Classification Search
CPC . F01L 1/181; F01L 1/2411; F01L 2001/2444; F01L 1/267; F01L 13/06; F01L 13/065; F02D 13/04
USPC ..... 123/90.15, 90.16, 90.36, 90.4, 90.44, 123/90.46
See application file for complete search history.

(56) References Cited

U.S. PATENT DOCUMENTS

2015/0144096 A1* 5/2015 Meneely ..... F01L 1/26 123/321
2016/0160711 A1* 6/2016 Lee ..... F02D 13/04 123/321

* cited by examiner

*Primary Examiner* — Jorge L Leon, Jr.
(74) *Attorney, Agent, or Firm* — Morgan, Lewis & Bockius LLP

(57) ABSTRACT

A compression release type engine brake includes an exhaust rocker arm including a roller which is mounted at one end portion thereof, and the exhaust rocker arm rotating around a rocker arm shaft by the rotation of the exhaust cam, a valve bridge disposed on the other end portion of the exhaust rocker arm and connected to an exhaust valve, a brake module mounted between the exhaust rocker arm and the valve bridge, contacting with the roller and the brake cam lobe according to inflow of selectively supplied operation oil to open the exhaust valve by the exhaust cam, and the brake module including a reset valve closing operation oil inside therein, and a reset piston slidably mounted on the second end portion of the exhaust rocker arm and protruding out of the second end portion of the exhaust rocker arm according to the supply of reset oil to push the reset valve to expel the operation oil in the brake module outwards.

19 Claims, 11 Drawing Sheets

COMPRESSION RELEASE TYPE ENGINE BRAKE

CROSS-REFERENCE TO RELATED APPLICATION

The present application claims priority to Korean Patent Application No. 10-2020-0187323 filed on Dec. 30, 2020, the entire contents of which is incorporated herein for all purposes by this reference.

BACKGROUND OF THE PRESENT INVENTION

Field of the Invention

The present invention relates to a compression release type engine brake. More particularly, the present invention relates to a compression release type engine brake that initializes internal pressure by automatically exhausting the operation oil flowing into the engine during engine brake operation.

Description of Related Art

In general, the hydraulic pressure type brake of a vehicle applies braking to the vehicle such that lowers the transmission ratio of the gear. This is because the shifting stage may be adjusted downward, so that excessive load acts on each portion of the engine and shortens the life of the engine.

The compression release type engine brake, which is a kind of engine brake, temporarily opens the exhaust valve near the compression top dead center of the piston and exhausts the compressed air from the cylinder during the basic four strokes of the engine. It induces the pumping loss of the expansion stroke so that the braking effect may be obtained.

For compression release type engine brakes according to related art, a brake module is applied between a valve bridge connected to a pair of exhaust valves, and an exhaust rocker arm.

The brake module forms a brake piston inside the housing where the brake oil inflows, and during engine brake operation, the brake piston moves downward to remove the gap between the exhaust rocker arm and the exhaust cam. Through this, it is configured to open the exhaust valve forcibly at the end of the compress stroke.

This brake module opens the exhaust valve at the end of the compress stroke and adds braking force to the vehicle. However, when the engine brake oil flows into the brake module once, it is not exhausted immediately, so that the exhaust valve opens further due to the oil pressure formed in the brake module.

FIG. 11 is a graph showing the amount of valve lift displacement that appears to be during the operation of a general compression release type engine brake.

As shown in FIG. 11, when the exhaust brake operates, there is a possibility that contact A between the exhaust valve and the engine piston may occur.

On the other hand, to improve this, a compression release type engine brake provided with a reset bracket is provided on one side of the brake module. There is a drawback that increases this size.

Furthermore, in the case of operating the reset valve through the movement of the reset bracket attached to the exhaust rocker arm, the reset valve lift is limited because the position of the reset bracket is fixed. In other words, there is a problem that the generated lift is distributed to the assemble gap and the opening length.

The information included in this Background of the Invention section is only for enhancement of understanding of the background of the invention and may not be taken as an acknowledgement or any form of suggestion that this information forms the prior art already known to a person skilled in the art.

BRIEF SUMMARY

Various aspects of the present invention are directed to providing a compression release type engine brake which may prevent contact between the exhaust valve and the engine piston by automatically exhausting the engine brake oil supplied to the inside of the brake module and initializing the pressure inside the brake module during engine brake operation.

A compression release type engine brake according to various exemplary embodiments of the present invention may include an exhaust rocker arm including a roller which is rotatably mounted at a first end portion of the exhaust rocker arm and selectively contacts with the exhaust cam, and the exhaust rocker arm rotating around a rocker arm shaft by the rotation of the exhaust cam, a valve bridge disposed on the other end portion of the exhaust rocker arm and connected to an exhaust valve, a brake module mounted between the exhaust rocker arm and the valve bridge, contacting with the roller and the brake cam lobe according to inflow of selectively supplied operation oil to open the exhaust valve by the exhaust cam, and the brake module including a reset valve closing operation oil inside therein, and a reset piston slidably mounted on the second end portion of the exhaust rocker arm and protruding out of the second end portion of the exhaust rocker arm according to the supply of reset oil to push the reset valve to expel the operation oil in the brake module outwards.

The brake module may include a brake module housing having a module inlet through which the operation oil is inflow, a module outlet through which the operation oil is exhausted, a reset valve mounting portion on which the reset valve is movably mounted, and a brake piston mounting portion formed therein, a brake piston movably provided on the brake piston mounting portion, and a reset valve elastic portion elastically supporting the reset valve, wherein the reset valve is provided to selectively block the module outlet.

The brake piston may have an accommodating chamber, and the brake module may further include a check valve movably provided in the accommodating chamber to block the module inlet, and a check valve elastic portion for elastically supporting the check valve.

The compression release type engine brake according to various exemplary embodiments of the present invention may further include a reset piston chamber formed so that the reset piston is movably provided at the other end portion of the exhaust rocker arm, and a reset oil supply portion selectively supplying the reset oil to the reset piston chamber.

The reset oil supply portion may include a rocker arm reset oil line formed on the exhaust rocker arm, and a rocker arm shaft reset oil supply line formed on the rocker arm shaft to supply the reset oil by fluidically communicating with the rocker arm reset oil line when the exhaust rocker arm is positioned at a first predetermined angle.

The compression release type engine brake according to various exemplary embodiments of the present invention may further include a rocker arm shaft reset oil exhaust line formed on the rocker arm shaft to exhaust the reset oil by fluidically communicating with the rocker arm reset oil line when the exhaust rocker arm is positioned at a second predetermined angle.

The compression release type engine brake according to various exemplary embodiments of the present invention may further include an operation oil supply portion selectively supplying oil to the brake module.

The operation oil supply portion may include a rocker arm operation oil line formed on the exhaust rocker arm, a rocker arm shaft operation oil supply line formed on the rocker arm shaft to fluidically communicate with the rocker arm operation oil line to supply the operation oil, and a solenoid valve configured for selectively supplying operation oil to the rocker arm shaft operation oil supply line.

A compression release type engine brake according to various exemplary embodiments of the present invention may include an exhaust cam having a main cam lobe and a brake cam lobe, an exhaust rocker arm including a roller which is rotatably mounted at a first end portion of the exhaust rocker arm and selectively contacts with the exhaust cam, and of which a reset piston chamber, a rocker arm that fluidically communicates with the reset piston chamber, a reset oil line and a rocker arm operation oil line are formed at the other end portion of the exhaust rocker arm, a rocker arm shaft on which the exhaust rocker arm is rotatably mounted, wherein a rocker arm shaft reset oil supply line is formed on the rocker arm shaft to supply the reset oil by fluidically communicating with the rocker arm reset oil line when the exhaust rocker arm is positioned at a first predetermined angle, and the rocker arm shaft on which a rocker arm shaft operation oil supply line is formed on the rocker arm shaft to fluidically communicate with the rocker arm operation oil line to supply the operation oil, a valve bridge disposed on the second end portion of the exhaust rocker arm and connected to exhaust valves, a brake module mounted between the exhaust rocker arm and the valve bridge, contacting with the roller and the brake cam lobe according to inflow of the operation oil to open the exhaust valve by the exhaust cam, and the brake module including a reset valve closing operation oil inside therein, and a reset piston mounted to be movable in the reset piston chamber, and configured for protruding according to the supply of reset oil to push the reset valve to expel the operation oil in the brake module outwards.

The compression release type engine brake according to various exemplary embodiments of the present invention may further include a rocker arm shaft reset oil exhaust line formed on the rocker arm shaft to exhaust the reset oil by fluidically communicating with the rocker arm reset oil line when the exhaust rocker arm is positioned at a second predetermined angle.

The rocker arm shaft reset oil exhaust line may be formed in an axial direction of the rocker arm shaft.

The compression release type engine brake according to various exemplary embodiments of the present invention may further include a solenoid valve configured for selectively supplying operation oil to the rocker arm shaft operation oil supply line.

One end portion of the rocker arm shaft operation oil supply line may be formed as a slit so that the rocker arm shaft operation oil supply line always communicates with the rocker arm operation oil line.

The brake module may include a brake module housing having a module inlet through which the operation oil is inflow, a module outlet through which the operation oil is exhausted, a reset valve mounting portion on which the reset valve is movably mounted, and a brake piston mounting portion formed therein, a brake piston movably provided on the brake piston mounting portion, and a reset valve elastic portion elastically supporting the reset valve, and the reset valve may be provided to selectively block the module outlet.

The brake piston may have an accommodating chamber, and the brake module may further include a check valve movably provided in the accommodating chamber to block the module inlet, and a check valve elastic portion for elastically supporting the check valve.

According to various exemplary embodiments of the present invention, during engine brake operation, the engine brake oil supplied to the inside of the brake module is automatically exhausted and the pressure inside the brake module is initialized and thus, it may prevent the engine piston from contacting.

According to the compression release type engine brake according to various exemplary embodiments of the present invention, the reset piston is selectively protruded to generate a sufficient lift to open the reset valve regardless of the rotation radius of the rocker arm.

Furthermore, the effect obtained or predicted by various exemplary embodiments of the present invention will be disclosed directly or implicitly in the detailed description of various exemplary embodiments of the present invention. That is, various effects predicted according to various exemplary embodiments of the present invention will be disclosed within a detailed description to be described later.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
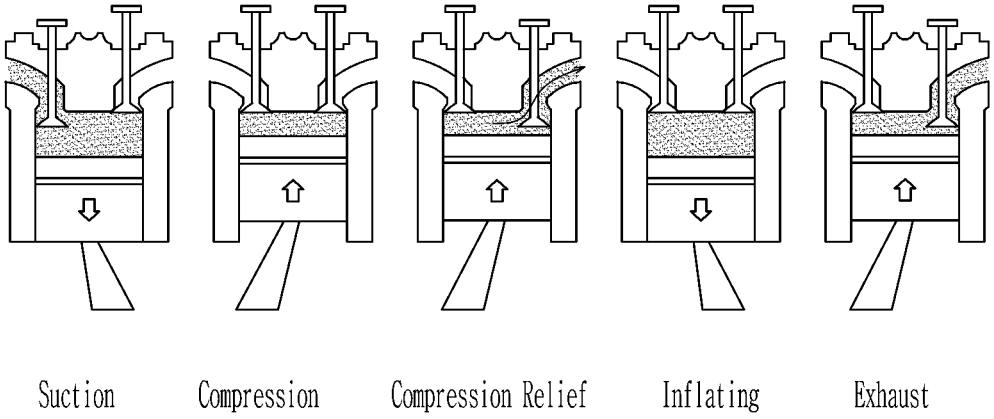
FIG. 1 is a drawing showing an engine cycle for explaining a compression release type engine brake according to various exemplary embodiments of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention To clearly describe the present invention, parts irrelevant to the description are omitted, and the same reference numerals are attached to the same or similar components throughout the specification.

Since the sizes and thicknesses of each component shown in the drawings are arbitrarily shown for convenience of description, the present invention is not necessarily limited to those shown in the drawings, and the thicknesses are enlarged to clearly express various parts and regions.

Furthermore, in the following detailed description, the names of the configurations are divided into first, second, etc. To distinguish the configurations in the same relationship, and are not necessarily limited to the order in the following description.

Throughout the specification, when a part includes a certain component, it means that other components may be further included rather than excluding other components unless specifically stated to the contrary.

Various exemplary embodiments of the present invention will hereinafter be described in detail with reference to the accompanying drawings.

FIG. 1 is a drawing showing an engine cycle for explaining a compression release type engine brake according to various exemplary embodiments of the present invention.

In general, engine brakes are applied to prevent premature wear of brake pads applied to foot brakes when a vehicle runs downhill or makes frequent sudden stops.

Here, the compression release type engine brake opens exhaust valves at the end of the compress stroke, among the basic four strokes of the engine, so that the engine braking performance may be exhibited.

The compression relaxation type engine brake temporarily opens the exhaust valve at the end of the compression stroke, that is, near the compression top dead center portion of the piston, among the basic four strokes of the engine to discharge compressed air in the cylinder out of the cylinder, it may induce a pumping loss in an expansion stroke to obtain a braking effect.

To the present end, the compression release type engine brake according to various exemplary embodiments of the present invention may be configured as follows.

Figure 2:
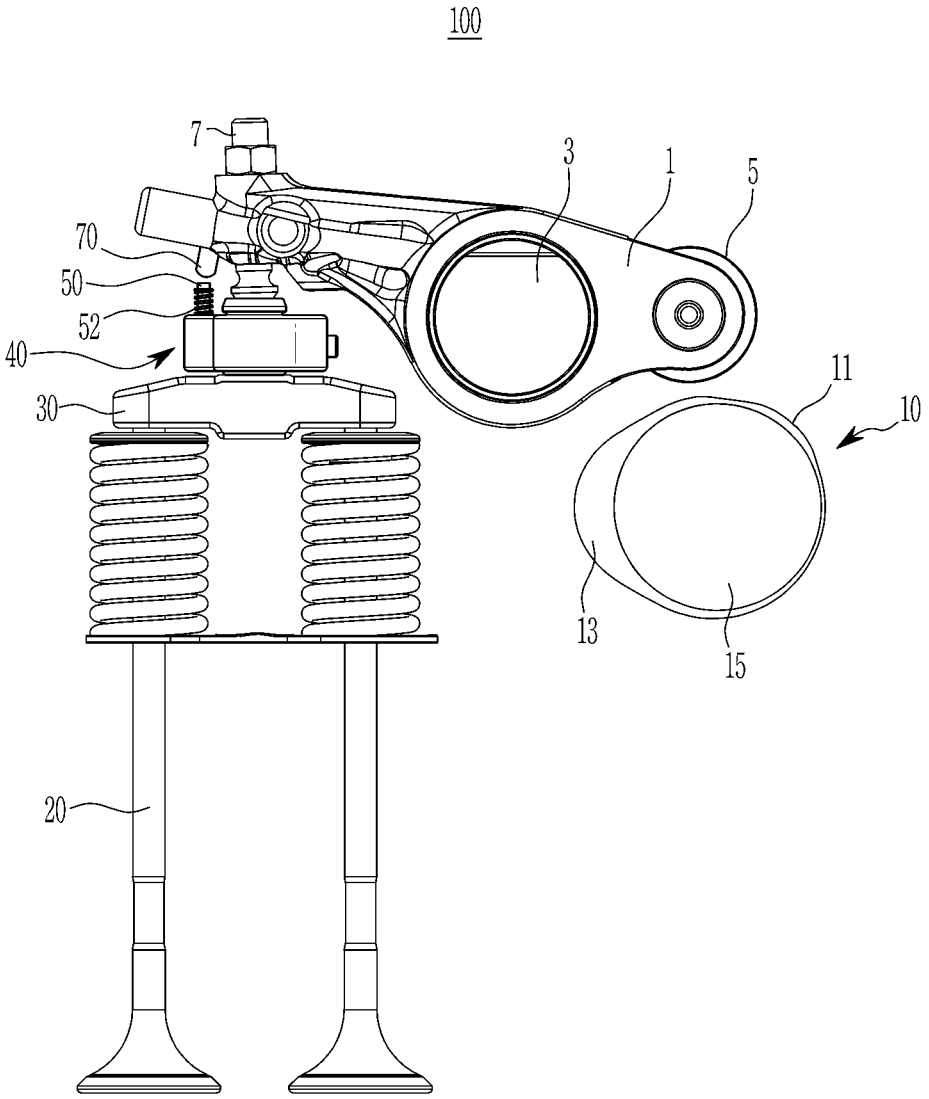
FIG. 2 is a front view of a compression release type engine brake according to various exemplary embodiments of the present invention.

FIG. 2 is a front view of a compression release type engine brake according to various exemplary embodiments of the present invention.

Referring to FIG. 2, in the compression release type engine brake, a rocker arm shaft 3 is inserted into an exhaust rocker arm 1 so that the exhaust rocker arm 1 rotates around the rocker arm shaft 3 and a roller 5 is mounted at one end portion of the exhaust rocker arm 1 and an adjusting screw 7 is mounted at the other end portion of the exhaust rocker arm 1.

The roller 5 is configured to be in contact or non-contact with an exhaust cam 10 mounted on a camshaft 15.

The adjusting screw 7 is mounted on the other end portion of the exhaust rocker arm 1 and connected to a valve bridge 30 through a brake module 40, described later.

The valve bridge 30 is connected to an exhaust valve 20, and the exhaust valve 20 may be provided in pairs.

And if the exhaust cam 10 is divided by profile, it may be divided into brake cam lobe section and main cam lobe section. The brake cam lobe section and main cam lobe section may be implemented by forming a brake cam lobe 11 and a main cam lobe 13 on camshaft 15.

The main cam lobe 13 contacts with the roller 5 to implement the exhaust stroke, and the brake cam lobe 11 contacts with the roller 5 to open the exhaust valve 20 during engine brake operation.

A bias spring is mounted on the exhaust rocker arm 1, and provides elastic force so that lifts one end corresponding to the roller 5 side of the exhaust rocker arm 1 is lifted and the adjusting screw 7 side of the exhaust rocker arm 1 is in close contact with the valve bridge 30 side thereof.

Therefore, in the state before engine brake operation (at the time of basic engine stroke), the roller 5 is always kept in a state separated from the brake cam lobe 11 of exhaust cam 10 by the elastic force of the bias spring and during the exhaust stroke, the roller 5 is pushed up only by the main cam lobe 13 of the exhaust cam 10.

In other words, if the operation oil for operating the engine brake is not supplied, there is a gap between roller 5 and exhaust cam 10 provided at the one end portion of the exhaust rocker arm 1, and thus the engine brake does not operate because the brake cam lobe 11 of the exhaust cam 10 and the roller 5 are not in contact.

On the other hand, when the operation oil is supplied to operate the engine brake, the brake module 40 lifts the other end portion of the exhaust rocker arm 1 and the roller 5 and the exhaust cam 10 are in constant contact. Therefore, at the end of the compress stroke, the exhaust rocker arm 1 is operated by the brake cam lobe 11 of the exhaust cam 10 to obtain a braking effect.

The compression release type engine brake according to various exemplary embodiments of the present invention includes a brake module 40 provided between the exhaust rocker arm 1 and the valve bridge 30.

Figure 3:
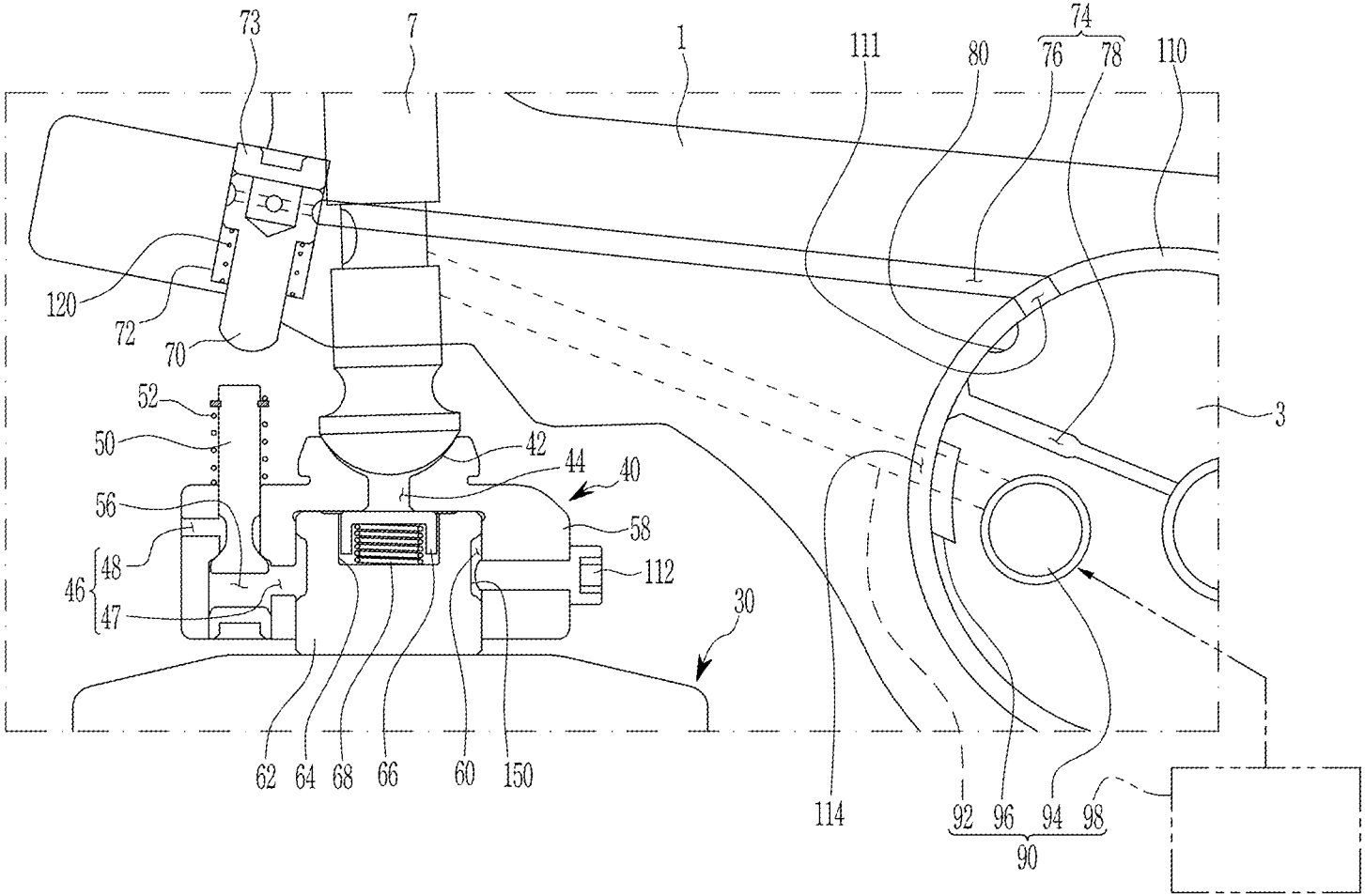
FIG. 3 is a cross-sectional view of a brake module and reset piston which may be applied to a compression release type engine brake according to various exemplary embodiments of the present invention.
Figure 4:
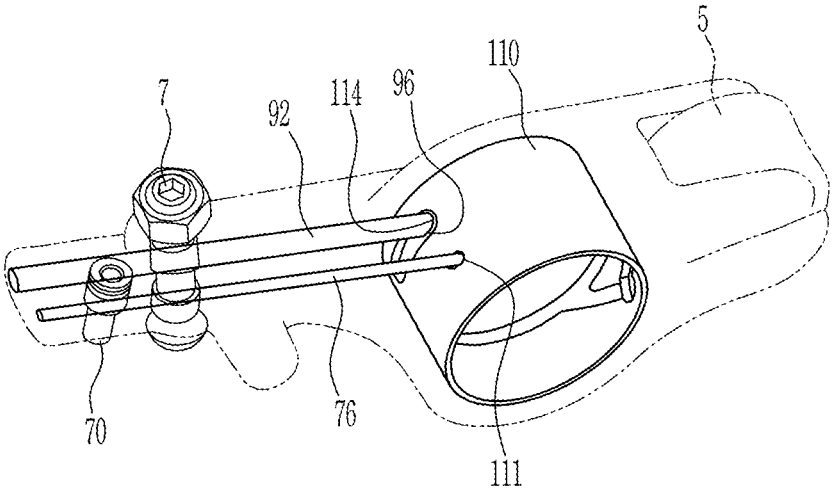
FIG. 4 is a projection view of an exhaust rocker arm which may be applied to a compression release type engine brake according to various exemplary embodiments of the present invention.

FIG. 3 is a cross-sectional view of a brake module and reset piston which may be applied to a compression release type engine brake according to various exemplary embodiments of the present invention, and FIG. 4 is a projection view of an exhaust rocker arm which may be applied to a compression release type engine brake according to various exemplary embodiments of the present invention.

Referring to FIG. 2, FIG. 3 and FIG. 4, the compression release type engine brake 100 according to various exemplary embodiments of the present invention may include the exhaust cam 10, the exhaust rocker arm 1, the valve bridge 30, the brake module 40 and a reset piston 70.

The brake module 40 is disposed between the exhaust rocker arm 1 and the valve bridge 30, and the roller 5 and the brake cam lobe 11 are contacted by the inflow of the selectively supplied operation oil, and the exhaust valve 20 is opened by a rotation of the exhaust cam 10, and the brake module 40 includes a reset valve 50 that blocks the operation oil inside thereof.

The reset piston 70 is mounted on the other end portion of the exhaust rocker arm 1 and protrudes according to the supply of reset oil, pushing the reset valve 50 to expel the operation oil in the brake module 40.

The brake module 40 may include a module inlet 44 where the operation oil inflows, a module outlet 46 where the operation oil is exhausted, a reset valve mounting portion 56 on which the reset valve 50 is mounted and a brake module housing 58 on which the brake piston mounting portion 60 is formed, a brake piston 62 movably provided on the brake piston mounting portion 60, and a reset valve elastic portion 52 for elastically supporting the reset valve 50. The reset valve 50 may be provided to selectively block the module outlet 46.

The brake module 40 may be formed with a seating portion 42 on which one end portion of the adjustment screw 7 is accommodated, and the seating portion 42 may be formed to fluidically communicate with the module inlet 44.

The module outlet 46 includes a first module outlet 47 that fluidically communicates with the brake piston mounting portion 60 and the reset valve mounting portion 56 and a second module outlet 48 that communicates externally with the reset valve mounting portion 56.

The reset valve 50 remains moved to the upper part of the drawing by the elastic force of the reset valve elastic portion 52 and blocks the module outlet 46.

An accommodating chamber 64 is formed on the brake piston 62, and the brake module 40 may further include a check valve 66 which is movably provided in the accommodating chamber 64 to block the module inlet 44, and a check valve elastic portion 68 that elastically supports the check valve 66.

A groove 150 may be formed on the side of the brake piston 62 in up and down directions, and position pin 112 is inserted into the brake module housing 58 so that one end portion of the position pin 112 may be protruded toward the groove. The position pin 112 may limit the movement of the brake piston 62 beyond the length of the groove.

Figure 5:
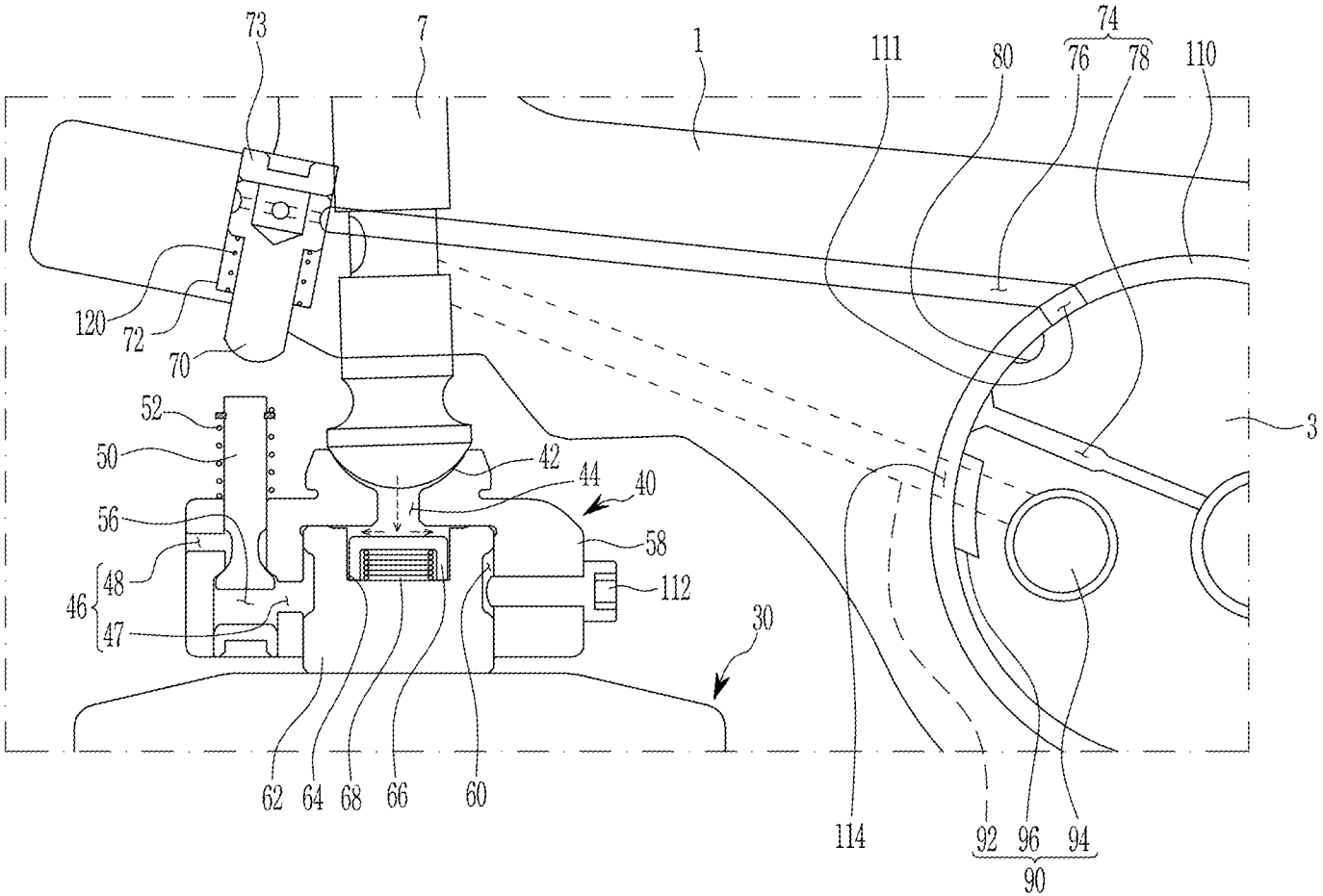
FIG. 5 and FIG. 6 is a cross-sectional view showing an operation of an exhaust brake of a compression release type engine brake according to various exemplary embodiments of the present invention.
Figure 6:
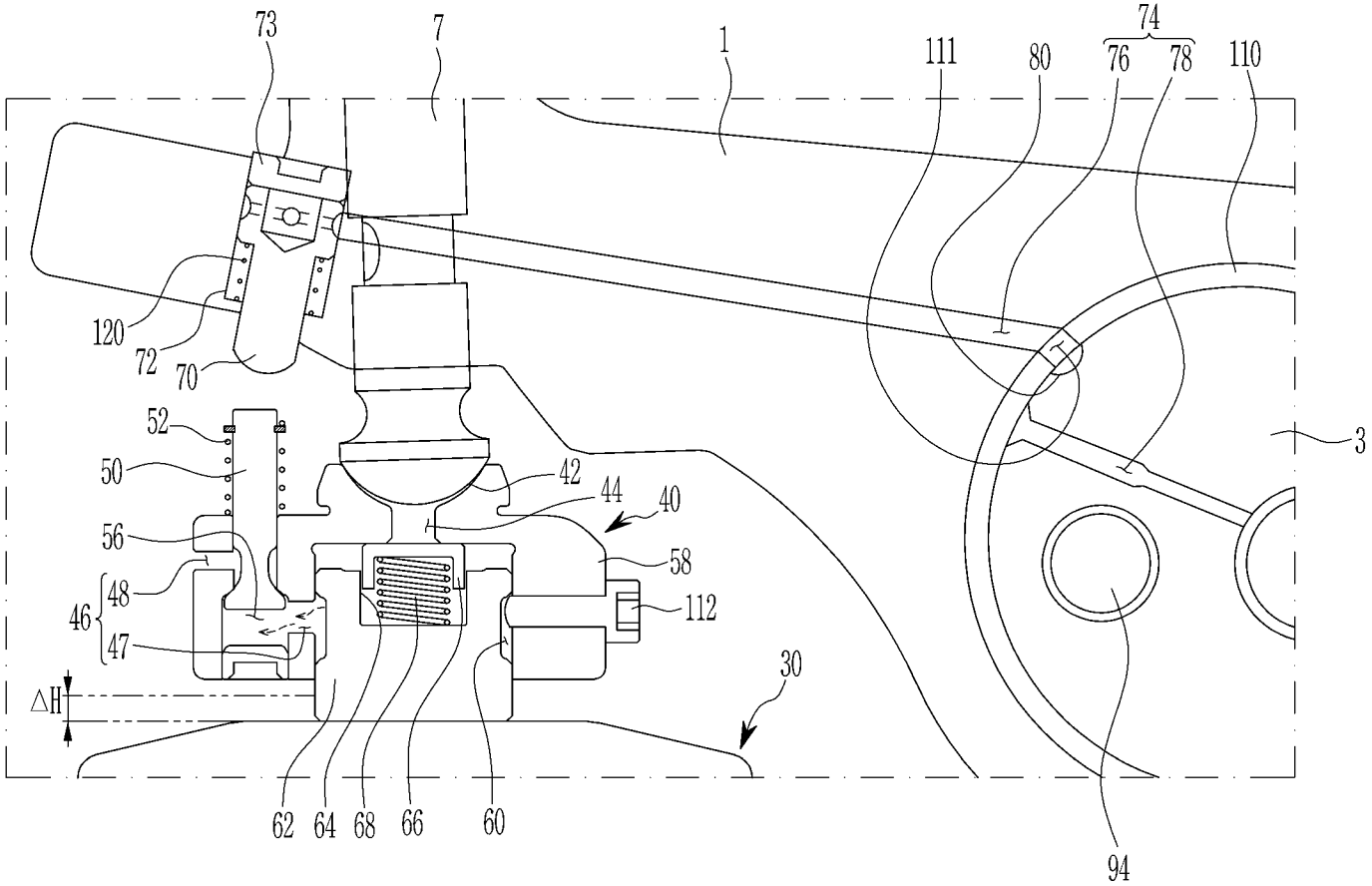
Figure 7:
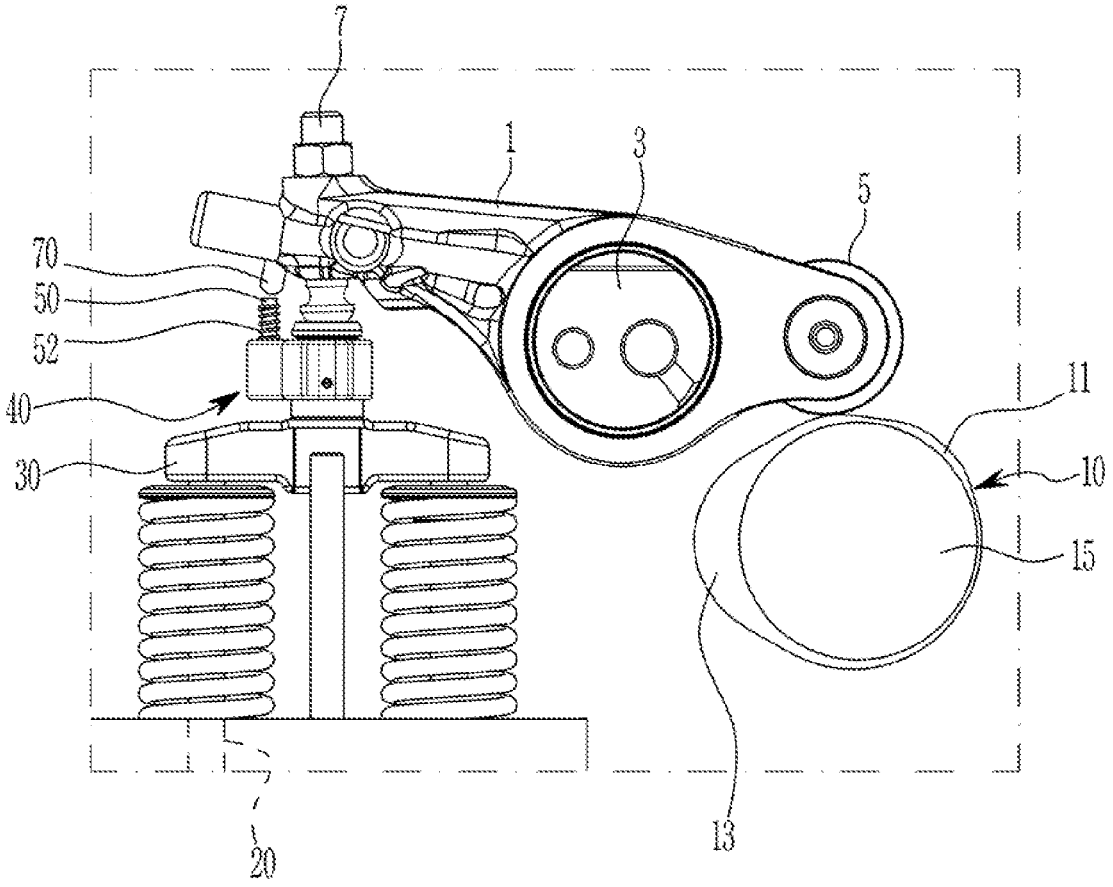
FIG. 7 is a partial front view showing an operation of an exhaust brake of a compression release type engine brake according to various exemplary embodiments of the present invention.

FIG. 5 and FIG. 6 is a cross-sectional view showing an operation of an exhaust brake of a compression release type engine brake according to various exemplary embodiments of the present invention, and FIG. 7 is a partial front view showing an operation of an exhaust brake of a compression release type engine brake according to various exemplary embodiments of the present invention.

Referring to FIG. 1 to FIG. 7, the compression release type engine brake 100 according to various exemplary embodiments of the present invention may further include a reset piston chamber 72 formed so that the reset piston 70 is movably provided at the other end portion of the exhaust rocker arm 1, and a reset oil supply portion 74 selectively supplying the reset oil to the reset piston chamber 72. A reset piston chamber cap 73 is attached to the upper portion of the reset piston chamber 72 to close and seal the reset piston chamber 72.

The reset oil supply portion 74 may include a rocker arm reset oil line 76 formed on the exhaust rocker arm 1, and a rocker arm shaft reset oil supply line 78 formed on the rocker arm shaft 3 to supply the reset oil by fluidically communicating with the rocker arm reset oil line 76 when the exhaust rocker arm 1 is positioned at a first predetermined angle.

The compression release type engine brake 100 according to various exemplary embodiments of the present invention may further include a rocker arm shaft reset oil exhaust line 80 formed on the rocker arm shaft 3 to exhaust the reset oil by fluidically communicating with the rocker arm reset oil line 76 when the exhaust rocker arm 1 is positioned at a second predetermined angle.

The compression release type engine brake 100 according to various exemplary embodiments of the present invention may further include an operation oil supply portion 90 for selectively supplying oil to the brake module 40.

The operation oil supply portion 90, referring to FIG. 3 and FIG. 4, may include a rocker arm operation oil line 92 formed on the exhaust rocker arm 1, a rocker arm shaft operation oil supply line 94 formed on the rocker arm shaft 3 to fluidically communicate with the rocker arm operation oil line 92 to supply the operation oil, and a solenoid valve 98 selectively supplying operation oil to the rocker arm shaft operation oil supply line 94.

A sliding bearing 110 may be mounted between the exhaust rocker arm 1 and the rocker arm shaft 3.

A sliding bearing 110 may be rotated relative to the rocker arm shaft 3 together with the exhaust rocker arm 1.

A hole 111 corresponding to the rocker arm reset oil line 76 is formed in the sliding bearing 110 so that the rocker arm reset oil line 76 and the rocker arm shaft reset oil supply line 78 may fluidically communicate.

A hole 114 corresponding to the rocker arm operation oil line 92 is formed in the sliding bearing 110 so that the rocker arm operation oil line 92 and the rocker arm shaft operation oil supply line 94 can fluidically communicate.

Figure 8:
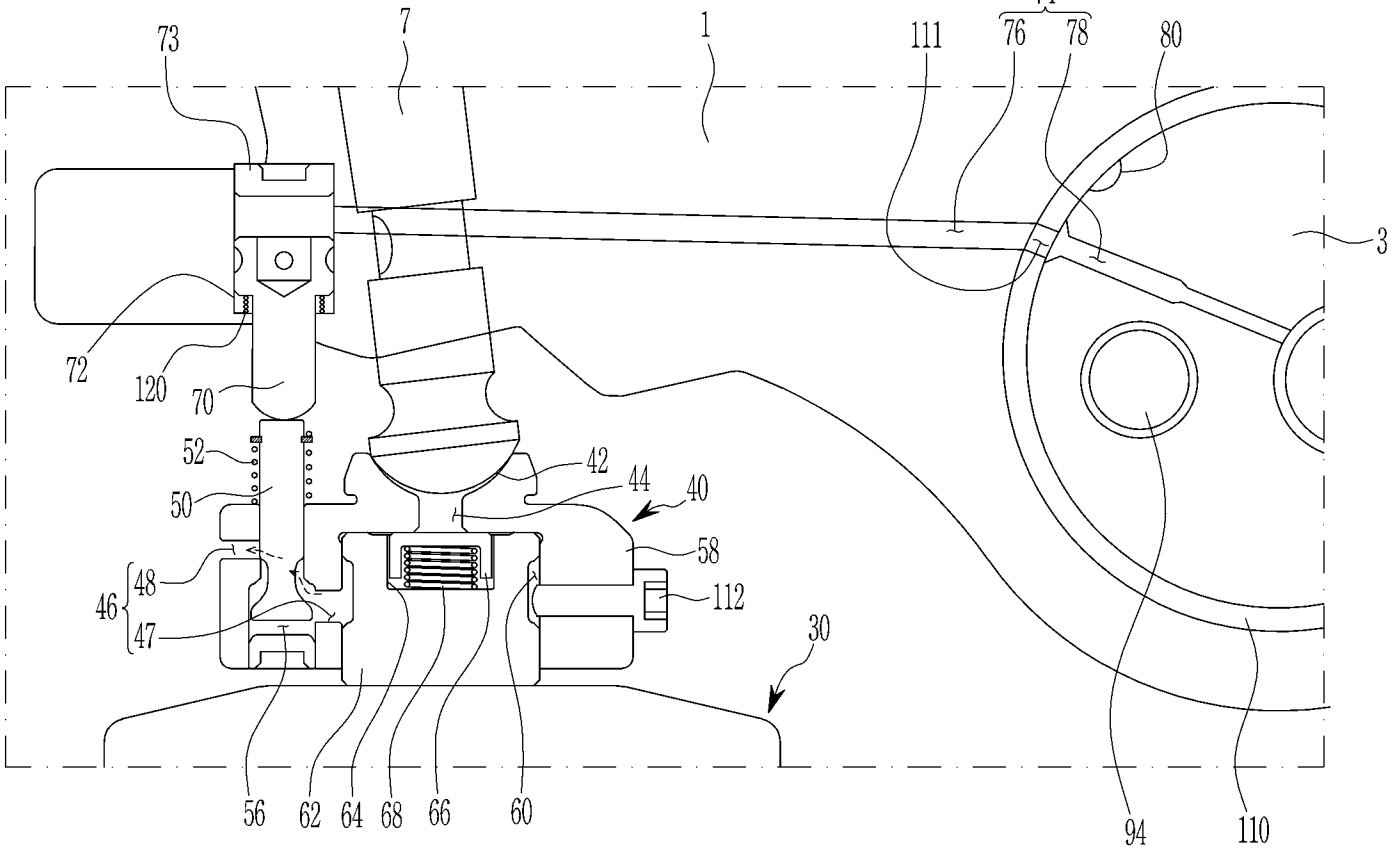
FIG. 8 and FIG. 9 is a cross-sectional view showing an operation at the time of releasing the exhaust brake of the compression release type engine brake according to various exemplary embodiments of the present invention.
Figure 9:
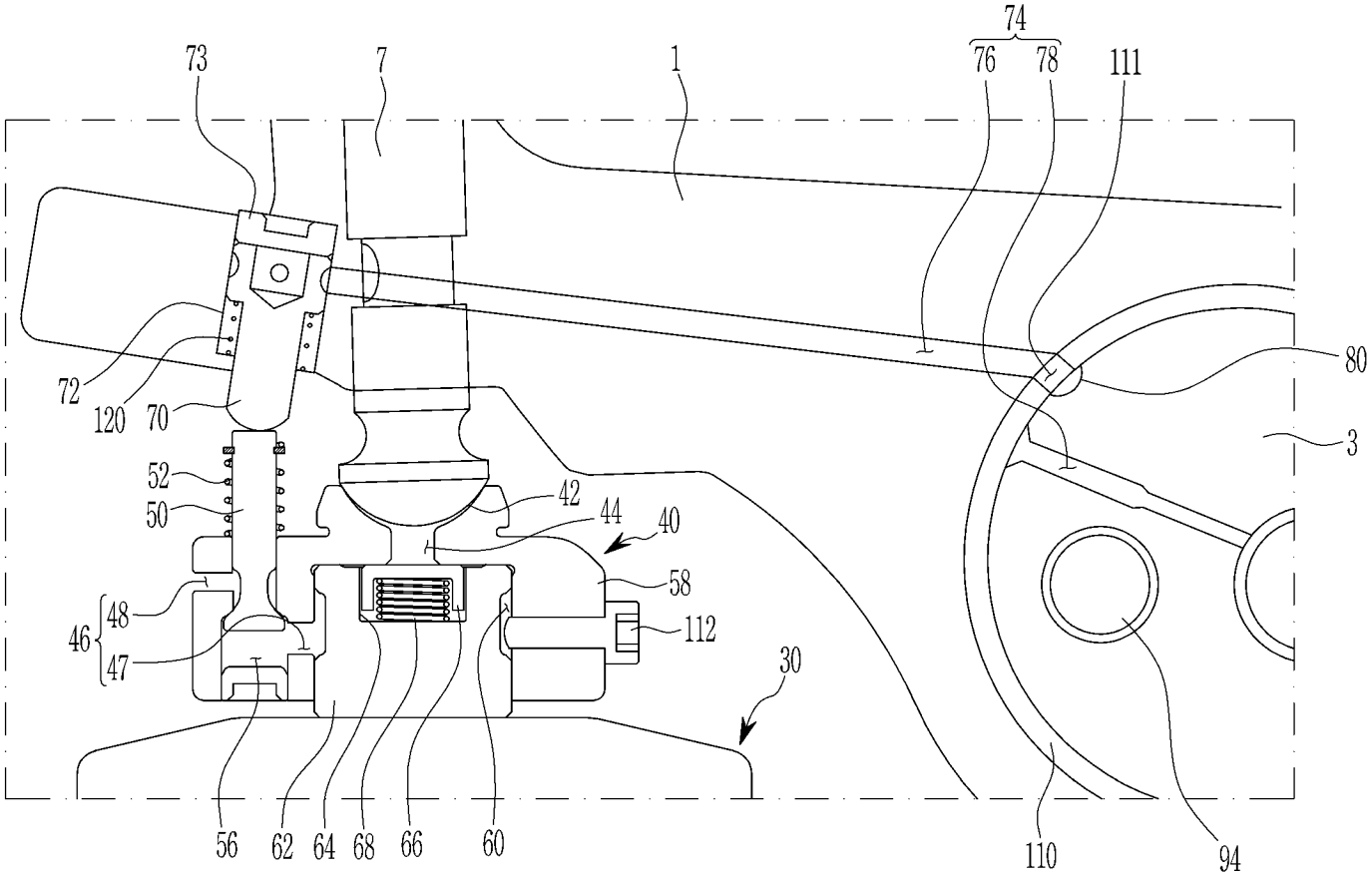
Figure 10:
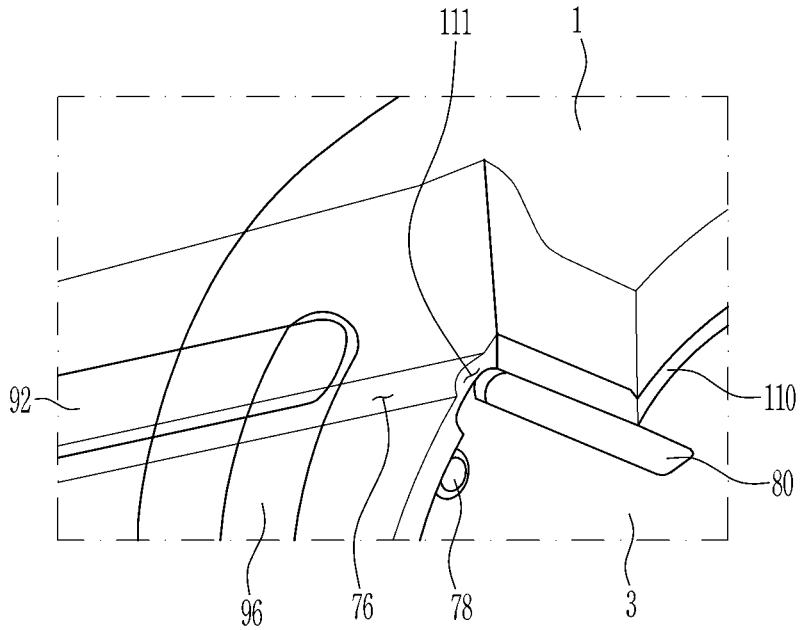
FIG. 10 is a partial cutaway view showing a rocker arm shaft reset oil exhaust line of a compression release type engine brake according to various exemplary embodiments of the present invention.
Figure 11:
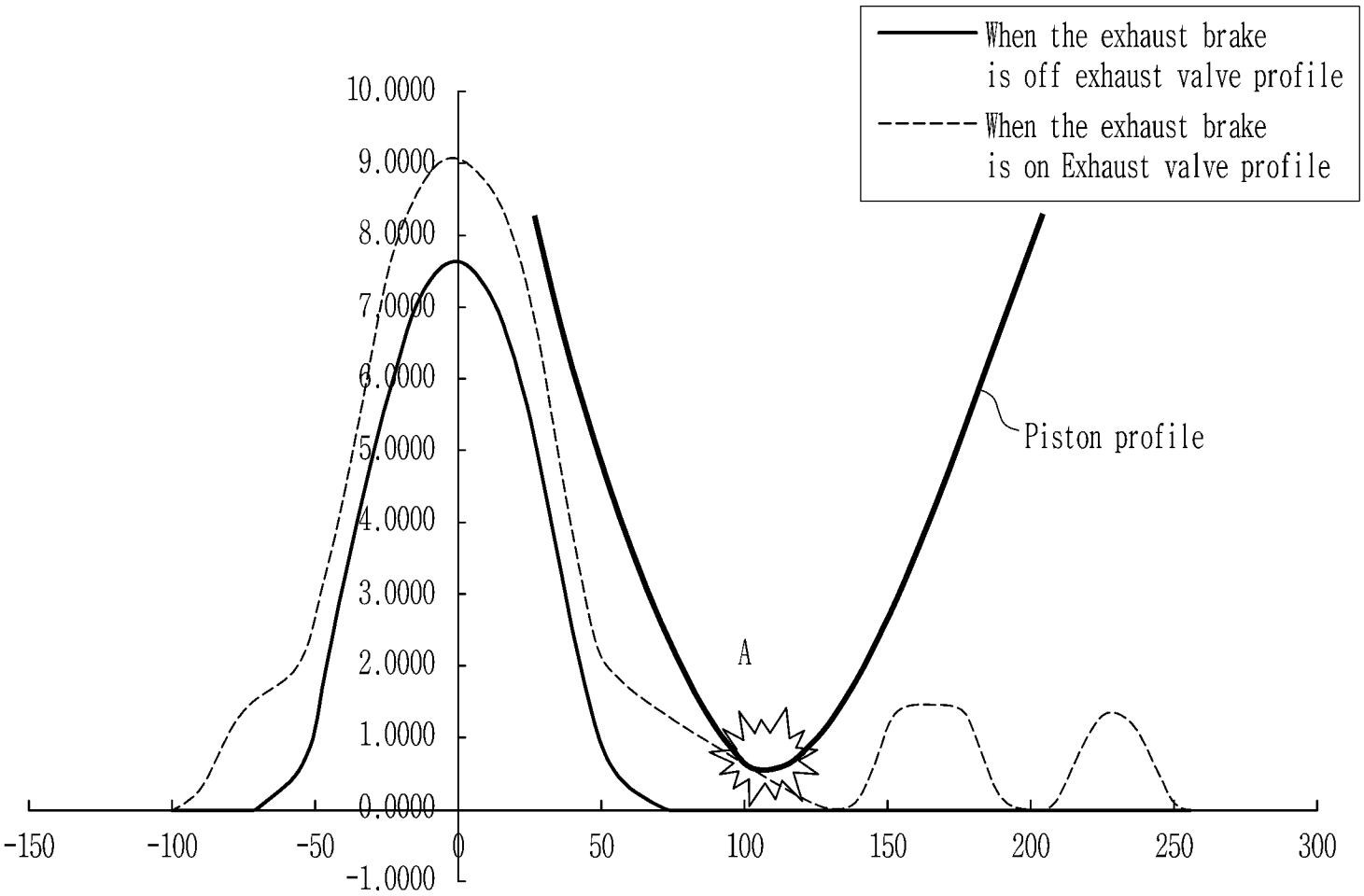
FIG. 11 is a graph showing the amount of valve lift displacement that appears during the operation of a general compression release type engine brake.

FIG. 8 and FIG. 9 is a cross-sectional view showing an operation at the time of releasing the exhaust brake of the compression release type engine brake according to various exemplary embodiments of the present invention, and FIG. 10 is a partial cutaway view showing a rocker arm shaft reset oil exhaust line of a compression release type engine brake according to various exemplary embodiments of the present invention.

Hereinafter, referring to FIG. 1 to FIG. 10, the operation of the compression release type engine brake according to various exemplary embodiments of the present invention will be described.

During normal engine operation, the solenoid valve 98 does not operate, the brake cam lobe 11 and the roller 5 remain separated, and the exhaust valve 20 is opened when the main cam lobe 13 and the roller 5 contact.

When an engine control unit (ECU), not shown, measures the operation state of the vehicle and determines the operation of the exhaust brake according to the operation state of the vehicle, the ECU operates the solenoid valve 98 to supply operation oil to the brake module 40.

That is, when operation oil is supplied to the rocker arm shaft operation oil supply line 94 by the open operation of the solenoid valve 98, the operation oil is supplied to and the rocker arm shaft operation oil supply line 94 and the rocker arm operation oil line 92, which communicates with the rocker arm shaft operation oil supply line 94.

One end portion of the rocker arm shaft operation oil supply line 94 may be formed as a slit 96 (see FIG. 3 and FIG. 4) to always communicate with the rocker arm operation oil line 92.

The operation oil is delivered to the module inlet 44 through an oil passage of the adjusting screw 7.

Referring to FIG. 5 to FIG. 7, when the operation oil is supplied to the module inlet 44, the check valve 66 is pushed by the pressure of the operation oil and the operation oil is supplied to the brake piston mounting portion 60 inside the brake module housing 58.

Accordingly, the brake piston 62 descends by the operation oil, the check valve 66 closes the module inlet 44 by the restoring force of the check valve elastic portion 68, and the brake piston mounting portion 60 is closed.

In other words, the brake piston 62 moves to the lower portion by the operation oil, and the relative length of the brake module 40 increases (ΔH), and the exhaust rocker arm 1 is rotated relative to the rocker arm shaft 3 (clockwise).

Accordingly, as shown in FIG. 7, the roller 5 of the exhaust rocker arm 1 and the exhaust cam 10 are in contact.

Accordingly, the main cam lobe 13 contacts with the roller 5 to implement the exhaust stroke, and the brake cam lobe 11 temporarily opens the exhaust valve 20 at the end portion of the compression stroke (near the compression top dead center portion of the piston) to induce a pumping loss of the expansion stroke and obtain a braking effect.

When the exhaust rocker arm 1 is positioned at the first predetermined angle, that is, as shown in FIG. 8, the rocker arm reset oil line 76 and the rocker arm shaft reset oil supply line 78 communicate with each other, so that reset oil is supplied to the reset piston chamber 72, and the reset piston 70 protrudes. That is, the reset piston 70 moves downward and pushes the reset valve 50, the reset valve 50 moves downward, and the module outlet 46 is opened.

Accordingly, the operation oil inside the brake piston mounting portion 60 may be expelled to the outside through the first module outlet 47, the reset valve mounting portion 56 and the second module outlet 48.

Later, as shown in FIG. 9, when the exhaust rocker arm 1 is positioned at the second predetermined angle, the rocker arm reset oil line 76 and the rocker arm shaft reset oil exhaust line 80 communicate with each other, and the reset piston 70 and the reset valve 50 are repositioned by the restoring force of the reset valve elastic portion 52. That is, the reset piston 70 moves upward to the inside of the reset piston chamber 72, and the reset valve 50 blocks the reset valve mounting portion 56. At the instant time, the reset oil inside the reset piston chamber 72 is expelled to the outside through the reset oil exhaust line 80.

In an exemplary embodiment of the present invention, the first and second predetermined angles may be measured with respect to an imaginary line extending horizontally.

Referring to FIG. 10, the rocker arm shaft reset oil exhaust line 80 may be formed in the axial direction of the rocker arm shaft 3.

In the general compression release type engine brake, which applies the reset bracket to the outside of the reset module, the position of the reset bracket is fixed and the lift of the reset valve is limited.

However, in the compression release type engine brake according to various exemplary embodiments of the present invention, the lift of the reset piston 70 according to the rotation of the exhaust rocker arm 1 and the lift of the reset piston 70 according to the supply of the reset oil are added, and thus the lift amount of the reset valve 50 may be properly secured.

The compression release type engine brake according to various exemplary embodiments of the present invention allows operation of the reset piston 70 without a separate solenoid mount other than a solenoid valve for operating the exhaust brake, so it may be configured without increasing the number of parts and weight.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. An engine brake comprising:

an exhaust cam having a main cam lobe and a brake cam lobe;

an exhaust rocker arm including a first end portion and a second end portion, the exhaust rocker arm configured to rotate about a rocker arm shaft so as to open an exhaust valve when the first end portion is actuated by the main cam lobe;

a roller rotatably mounted at the first end portion, the roller configured to selectively contact the exhaust cam so as to engage the brake cam lobe, thereby effecting a brake lift of the exhaust valve;

a valve bridge disposed between the second end portion and the exhaust valve;

a brake module mounted between the second end portion and the valve bridge, the brake module configured to act on the second end portion so as to rotate the exhaust rocker arm such that the roller engages the brake cam lobe when the brake module is supplied with operation oil;

a reset valve disposed in the brake module, the reset valve configured to retain the operation oil inside the brake module; and a reset piston slidably mounted at the second end portion, the reset piston configured to protrude out of the second end portion so as to push down on the reset valve such that the operation oil is expelled from the brake module when the reset piston is supplied with reset oil.

2. The engine brake of claim 1, wherein the brake module comprises:

a brake module housing including:

a module inlet through which the operation oil is supplied, a module outlet through which the operation oil is expelled, a reset valve mounting portion in which the reset valve is movably mounted, and a brake piston mounting portion;

a brake piston movably provided in the brake piston mounting portion; and a reset valve elastic portion elastically supporting the reset valve, wherein the reset valve is configured to selectively block the module outlet.

3. The engine brake of claim 2, wherein the brake module further comprises a seating portion on which an end portion of an adjustment screw mounted at the second end portion is accommodated, and wherein the seating portion fluidically communicates with the module inlet.

4. The engine brake of claim 2, wherein the brake module further comprises:

a groove formed on a side of the brake piston; and a position pin inserted into the brake module housing such that an end portion of the position pin protrudes toward the groove, wherein the position pin limits a movement of the brake piston beyond a length of the groove.

5. The engine brake of claim 2, wherein the brake piston includes an accommodating chamber, and wherein the brake module further comprises:

a check valve movably provided in the accommodating chamber so as to selectively block the module inlet; and a check valve elastic portion elastically supporting the check valve.

6. The engine brake of claim 2, wherein the exhaust rocker arm further includes:

a reset piston chamber in which the reset piston is slidably mounted; and a reset oil supply portion selectively supplying the reset oil to the reset piston chamber.

7. The engine brake of claim 6, wherein the reset oil supply portion includes:

a rocker arm reset oil line formed in the exhaust rocker arm; and a rocker arm shaft reset oil supply line formed in the rocker arm shaft, the rocker arm shaft reset oil supply line configured to supply the reset oil to the rocker arm reset oil line when the exhaust rocker arm is positioned at a first predetermined angle.

8. The engine brake of claim 7, further comprising:

a rocker arm shaft reset oil exhaust line formed in the rocker arm shaft, the rocker arm shaft reset oil exhaust line configured to exhaust the reset oil from the rocker arm reset oil line when the exhaust rocker arm is positioned at a second predetermined angle.

9. The engine brake of claim 1, further comprising:

an operation oil supply portion selectively supplying the operation oil to the brake module.

10. The engine brake of claim 9, wherein the operation oil supply portion includes:

a rocker arm operation oil line formed in the exhaust rocker arm;

a rocker arm shaft operation oil supply line formed in the rocker arm shaft, the rocker arm shaft operation oil supply line configured to supply the operation oil to the rocker arm operation oil line; and a solenoid valve configured to selectively supply the operation oil to the rocker arm shaft operation oil supply line.

11. An engine brake comprising:

an exhaust cam having a main cam lobe and a brake cam lobe;

an exhaust rocker arm including a first end portion and a second end portion, the exhaust rocker arm configured to rotate about a rocker arm shaft so as to open an exhaust valve when the first end portion is actuated by the main cam lobe;

a roller rotatably mounted at the first end portion, the roller configured to selectively contact the exhaust cam so as to engage the brake cam lobe, thereby effecting a brake lift of the exhaust valve;

a valve bridge disposed between the second end portion and the exhaust valve;

a brake module mounted between the second end portion and the valve bridge, the brake module configured to act on the second end portion so as to rotate the exhaust rocker arm such that the roller engages the brake cam lobe when the brake module is supplied with operation oil;

a reset valve disposed in the brake module, the reset valve configured to retain the operation oil inside the brake module; and a reset piston slidably mounted at the second end portion, the reset piston configured to protrude out of the second end portion so as to push down on the reset valve such that the operation oil is expelled from the brake module when the reset piston is supplied with reset oil, wherein the exhaust rocker arm further includes:

a reset piston chamber in which the reset piston is slidably mounted, a rocker arm reset oil line configured to supply the reset oil to the reset piston chamber, and a rocker arm operation oil line configured to supply the operation oil to the brake module, and wherein the rocker arm shaft includes:

a rocker arm shaft reset oil supply line configured to supply the reset oil to the rocker arm reset oil line when the exhaust rocker arm is positioned at a first predetermined angle, and a rocker arm shaft operation oil supply line configured to supply the operation oil to the rocker arm operation oil line.

12. The engine brake of claim 11, wherein the rocker arm shaft further includes:

a rocker arm shaft reset oil exhaust line configured to exhaust the reset oil from the rocker arm reset oil line when the exhaust rocker arm is positioned at a second predetermined angle.

13. The engine brake of claim 12, wherein the rocker arm shaft reset oil exhaust line extends in an axial direction of the rocker arm shaft.

14. The engine brake of claim 11, further comprising:

a solenoid valve configured to selectively supply the operation oil to the rocker arm shaft operation oil supply line.

15. The engine brake of claim 14, wherein an end portion of the rocker arm shaft operation oil supply line is formed as a slit so as to be in continuous communication with the rocker arm operation oil line.

16. The engine brake of claim 11, wherein the brake module comprises:

a brake module housing including:

a module inlet through which the operation oil is supplied, a module outlet through which the operation oil is expelled, a reset valve mounting portion in which the reset valve is movably mounted, and a brake piston mounting portion;

a brake piston movably provided in the brake piston mounting portion; and a reset valve elastic portion elastically supporting the reset valve, wherein the reset valve is configured to selectively block the module outlet.

17. The engine brake of claim 16, wherein the brake module further comprises a seating portion on which an end portion of an adjustment screw mounted at the second end portion is accommodated, and wherein the seating portion fluidically communicates with the module inlet.

18. The engine brake of claim 16, wherein the brake module further comprises:

a groove formed on a side of the brake piston; and a position pin inserted into the brake module housing such that an end portion of the position pin protrudes toward the groove, wherein the position pin limits a movement of the brake piston beyond a length of the groove.

19. The engine brake of claim 16, wherein the brake piston includes an accommodating chamber, and wherein the brake module further comprises:

a check valve movably provided in the accommodating chamber so as to selectively block the module inlet; and a check valve elastic portion elastically supporting the check valve.

* * * * *